US005526668A

United States Patent [19]

Futamura et al.

[11] Patent Number: 5,526,668

[45] Date of Patent: Jun. 18, 1996

[54] INDEX-FEED MACHINING SYSTEM

[75] Inventors: Shoji Futamura; Chikara Murata, both of Kawasaki, Japan

[73] Assignee: Institute of Technology Precision Electrical Discharge Work's, Kawasaki, Japan

[21] Appl. No.: 371,149

[22] Filed: Feb. 21, 1995

Related U.S. Application Data

[63] Continuation of Ser. No. 961,255, Oct. 15, 1992, abandoned.

[30] Foreign Application Priority Data

| | | | |
|---|---|---|---|
| Oct. 18, 1991 | [JP] | Japan | 3-269829 |
| Oct. 18, 1991 | [JP] | Japan | 3-269833 |
| May 12, 1992 | [JP] | Japan | 4-117848 |

[51] Int. Cl.[6] ..... B21D 28/00; B21D 37/10; B21D 37/14

[52] U.S. Cl. ..... 72/324; 72/404; 72/453.02; 72/453.07; 72/453.18; 29/33 Q; 29/33 S

[58] Field of Search ..... 72/404, 405, 472, 72/453.01, 453.02, 453.18, 339, 338, 336, 453.07, 453.08, 324; 470/99, 98, 96, 91, 109; 29/33 Q, 33 S, 564, 56.5, 26 A

[56] References Cited

U.S. PATENT DOCUMENTS

| | | | |
|---|---|---|---|
| 3,348,248 | 10/1967 | Milkert | 470/98 |
| 3,434,328 | 3/1969 | Taniguchi | 72/405 |
| 3,835,682 | 9/1974 | Elger | 72/404 |
| 3,987,721 | 10/1976 | Alexander | 72/405 |
| 4,079,617 | 3/1978 | Whiting | 72/453.02 |
| 4,510,789 | 4/1985 | Tomioka | 72/405 |
| 4,611,483 | 9/1986 | Hadaway | 72/453.02 |

FOREIGN PATENT DOCUMENTS

| | | | |
|---|---|---|---|
| 110594 | 6/1984 | European Pat. Off. . | |
| 870629 | 3/1953 | Germany | 470/96 |
| 1639863 | 4/1991 | U.S.S.R. | 72/453.07 |
| 567429 | 2/1945 | United Kingdom | 470/99 |
| 2062517 | 5/1981 | United Kingdom | 72/453.07 |

*Primary Examiner*—Daniel C. Crane
*Attorney, Agent, or Firm*—McGlew and Tuttle

[57] ABSTRACT

An index-feed machining system having such a construction that a plurality of machining units on the bodies of which cassettes incorporating a plurality of machining tools are detachably mounted are disposed at intervals at mP (m being a given positive integer, P being a workpiece-feeding pitch) in the workpiece-feeding direction, corresponding to a plurality of machining processes; the machining processes being sequentially performed by the machining units at the index-feed pitches of the workpiece, in which a drive for driving the machining means are provided in the cassettes comprising any machining units.

9 Claims, 11 Drawing Sheets

INDEX-FEED MACHINING SYSTEM

This is a continuation application of application Ser. No. 07/961,255 filed Oct. 15, 1992, now abandoned.

FIELD

This invention relates to an index-feed machining system for performing punching, bending, drawing and other types of machining on a workpiece, for example, in a set of systems by sequentially performing different types of machining while index-feeding the workpiece to the succeeding machining processes to complete the entire machining process in the final process.

BACKGROUND OF THE INVENTION

To manufacture sheet-metal products of a predetermined shape by performing punching, bending, drawing, compressing and other types of machining on a sheet-metal blank, such as a steel sheet, the workpiece has heretofore been subjected to several processes. When a large quantity of sheet-metal products is needed, a means for performing several machining processes or stages in a single machining metal die by sequentially feeding the workpiece to the succeeding stages to complete the entire machining process in the final stage has been adopted. This type of multi-stage machining metal die, called the progressive die, has an advantage of high efficiency because one sheet-metal product can be produced with one stamping stroke of the press.

While the conventional type of progressive die, as described above, has advantages of high production rates; short delivery time involved from the charging of a workpiece to the completion of machining and less in-process products; and volume production possible with a small number of workers, it has the following problems. The construction of the metal die becomes extremely complex because a plurality of punch-die sets must be incorporated in a single metal die, requiring a high level of metal-die manufacturing technology, leading to prolonged manufacturing time and increased manufacturing cost.

To replace and repair the damaged metal die, and adjust part of the metal die, the entire metal die has to be disassembled, involving troublesome work, and much time and labor accordingly. Furthermore, in a production system where a wide variety of products are manufactured in a small quantity, specially prepared metal dies have to be manufactured every time the shapes and sizes of workpieces are changed even only slightly. This leads to increased metal-die cost, and makes it difficult to adapt to the so-called flexible manufacturing system (FMS) the need for which has been increasing in recent years.

To solve these problems, the present Applicant has filed a patent application for an index-feed machining system which is simple in construction and can easily perform partial adjustment (Japanese Patent Application Nos. 121760/1990 and 121761/1990, for example). The present invention represents further improvements on these improvement inventions.

FIG. 1 is a perspective view illustrating the essential part of an example of index-feed machining system on which this invention is based. In FIG. 1, numerals 100–500 denote machining units disposed on a base 1 at intervals of 2P (P being a workpiece-feeding pitch) in the direction in which a workpiece (not shown) is fed. A pair of punch and die is provided in each of these machining units 100–500 for a plurality of machining processes. Now, the construction of this invention will be described, taking the machining unit 100 as an example. Numeral 101 denotes a machining unit body formed into an essentially U shape, and having a dovetail 102 integrally provided at the lower end thereof for engaging with a dovetail groove 103 provided on the base 1 so that the machining unit 100 can be adjusted for movement in the workpiece-feeding direction, and at the same time, can be limited in movement in the direction normal to the workpiece-feeding direction. Numeral 104 denotes a movement adjusting device; 105 a clamp; 106 a hydraulic cylinder provided at the upper end of the machining unit body 101; and 107 a position measuring device provided on the side surface of the hydraulic cylinder 106.

Numeral 108 denotes a cassette formed into an essentially U shape and detachably provided on the machining unit body 101, on the upper part of which vertically movably provided is a punch or die (not shown), and on the lower part of which provided is a die or punch (not shown) forming a pair with the aforementioned punch and die. The cassette 108 is positioned by engaging with positioning members 809 and 810, as shown in the machining unit 300 in the figure. Numeral 111 denotes a clamp screw. The cassette 108 is mounted and positioned at a predetermined location on the machining unit body 101 via positioning members (not shown. See numerals 309 and 310 in the machining unit 300.) and securely held in position by tightening the clamp screw 111. After the cassette 108 has been fixedly fitted to the machining unit body 101, the actuator (not shown) of the hydraulic cylinder 106 is connected to the vertically movable punch or die described above.

FIGS. 2A and 2B are diagrams of assistance in explaining the state where a workpiece is machined; FIG. 2A being a plan view and FIG. 2B a cross-sectional view. Like parts are indicated by like numerals shown in FIG. 1. In FIGS. 2A and 2B, numeral 2 denotes a workpiece intermittently fed at a pitch of P in the direction shown by an arrow in the figure. That is, the workpiece 2 is index-fed in a gap between a pair of punch and die provided in the cassette 108 (similarly with other cassettes) in FIG. 1 above. In FIGS. 1 through 2B, the machining units 100–500 are arranged corresponding to the punching process of pilot holes 3, the notching process of arc-segment-shaped notches 4 and the first to third drawing processes.

The machining unit 100 has a punch and die for punching the pilot holes 3, and guides (not shown) engaging with the pilot holes 3 at intervals of P on the downstream side in the direction in which the workpiece 2 is fed. Consequently, as the machining unit 100 is operated, the pilot holes 3 are sequentially punched, and the guides are engaged with the punched pilot holes 3 to prevent the workpiece 2 from unwantedly deviating from the predetermined location thereof, thereby keeping accuracy.

Next, arc-segment-shaped notches 4 are formed in the machining unit 200, the first drawing operation is performed in the machining unit 300 to form a cup-shaped projection 5 on the workpiece 2 while the arc-segment-shaped notches 4 are expanded in width, changing into arc-segment-shaped grooves 6. In the machining unit 400, the second drawing operation and the forming of flange holes 7 are performed, and the height of the projection 5 is increased. The third drawing is performed in the machining unit 500 to further form the projection to a predetermined height. Though not shown in the figures, edge-cutting and other operations are carried out to obtain a sheet-metal product of a predetermined cup shape. Needless to say, positioning is also carried out in the machining units 200–500 by providing guides engaging with the pilot holes 3 to maintain predetermined accuracy.

The index-feed machining system having the aforementioned construction is simple in construction, compared with connectional progressive dies, and easy to manufacture. It has an advantage in that high-efficiency machining can be achieved even in a production system in which a wide variety of products are manufactured in a small quantity, but the following problems are encountered in index-feed machining, including drawing operations.

FIGS. 3A through 3C are cross-sectional diagrams of assistance in explaining the state of drawing operations; FIG. 3A showing the state prior to drawing, FIG. 3B the state in the process of drawing, and FIG. 3C the state after drawing. In FIGS. 3A through 3C, numeral 11denotes a punch, and 12 a die, both corresponding to the machining units 100 and 200 shown in FIGS. 1 and 2A. Next, numeral 13 denotes a drawing die; and 14 a drawing punch, both corresponding to the machining units 300–500 shown in FIGS. 1 and 2A. In the drawing die 13 provided is a knockout pin 16 that is preloaded downward by a spring 15 and formed in a vertically slidable fashion. The drawing punch 14 is fixedly fitted to a retainer plate 17 and has a blank holding pad 18. The blank holding pad 18 is connected to a movable plate 20 via a rod 19 passing through the retainer plate 17 in a vertically movable fashion, and preloaded upwards by a spring 21.

To carry out a drawing operation with the above-mentioned construction, the punch 11 and the drawing die 13 are actuated downward from the state shown in FIG. 3A by the hydraulic cylinder 106 shown in FIG. 1 for example, then drawing is performed as shown in FIG. 3B. That is, punching is performed by engaging the punch 11 with the die 12, and drawing is performed by the drawing die 13 and the drawing punch 14. During drawing, the drawing die 13 and the blank holding pad 18, and the knockout pin 16 and the drawing punch 14 hold the workpiece 2 between them from above and below, then the drawing punch 14 enters in the drawing die 13 to carry out the drawing operation. During this drawing operation, the blank holding pad 18 forces the workpiece 2 onto the lower end face of the drawing die 14 by a predetermined spring pressure. Thus, the workpiece 2 is allowed to be moved horizontally at that location to cause the plastic deformation of the workpiece 2, and prevented from producing unwanted wrinkles. Symbol h denotes drawing depth or the height of the projection 5. Upon completion of drawing operation, the punch 11 and the drawing die 13 are moved upwards by the returning operation of the hydraulic cylinder 106, as shown in FIG. 3C, causing the workpiece 2 to be indexed. At this time, the projection 5 can be easily removed from the drawing die 13 because the knockout pin 16 is preloaded downward by the spring 15.

As is evident from FIG. 3B, the workpiece 2 is pushed down from the level before drawing to the drawing depth h during drawing, deformed between the punch 11 and the drawing die 13, and then returned to the original level after drawing operation, as shown in FIG. 3C. If the workpiece 2 is moved up and down in this way, tensile, compressive and bending stresses are generated in the workpiece 2, resulting in the deformation of products and lowered dimensional accuracy. Increasing the intervals of the machining units to eliminate these problems would increase the size of the entire system, requiring an unwantedly large space for the system.

As is evident from FIGS. 3A through 3C, the drawing die 13 reciprocates a stroke of $2h+\alpha$ for drawing operation. Symbol $\alpha$ used here is a gap set to ensure the smooth index-feeding of the workpiece 2. That is, a stroke of $2h+\alpha$ is needed for the drawing die 13 to draw to the drawing depth h. In general, the larger the stroke of a hydraulic cylinder, the larger becomes the required energy. In index-feed machining systems to which this invention is applied, in which a plurality of machining units have independent driving means, the use of the aforementioned hydraulic cylinders as driving means requires $2h+\alpha$ or more of stroke in machining means, including machining units succeeding the drawing process. This poses a problem of the increased required volume of operating fluid.

Next, the conventional index-feed machining systems usually handle strip-shaped workpieces, and therefore mostly involve bending, drawing, punching, piercing and other sheet-metal working. As a result, it is difficult to handle certain products incorporating tapped holes, for example, in the index-feed machining process. Such products are therefore manufactured by providing tapped holes separately on the workpiece 2 after the completion of the index-feed machining process. This results in increased cost.

Since the products obtained with index-feed machining are generally of small sizes and are manufactured continuously, the quantity of products in a production lot tends to be large. Providing tapped holes additionally on such a large quantity of products that have already been subjected to the index-feed machining not only requires special-purpose machining jigs, but also additional time and labor for mounting and removing products on the jigs. This poses some problems, such as increased machining cost and the difficulty in improving the dimensional accuracy due to variability in the reference plane.

Furthermore, independent special-purpose hydraulic cylinders 106 and other equipment are provided in a plurality of machining units, as shown in FIG. 1. While this arrangement permits the independent operation of the units and the standardization of common components for interchangeability, if a particular machining unit requires a larger drive force or working load than other units, a hydraulic cylinder of a special specification must be provided for that machining unit. This would not only increase manufacturing cost but also make it difficult to keep balance with other hydraulic cylinders.

Although there can be conceived means for reducing drive force or working load by dividing the particular machining process into multiple steps, this arrangement would increase the number of machining processes, requiring additional machining units to be installed. All this leads to increased cost and system size.

In addition, the operating fluid of hydraulic cylinders is usually maintained at the same pressure, a pressure as high as 140 $kg/cm^2$, for example In machining the workpiece as described above, however, operating fluid is required to be at a high level only when bending, drawing, punching or piercing operation is performed, but operating fluid need not always be kept operating at high pressure to cause the punch or die to come near or keep away from the workpiece. In hydraulic cylinders, on the other hand, a large amount of energy is required to raise the pressure of operating fluid. Since conventional hydraulic cylinders require high-pressure operating fluid at all times, and involve larger strokes than needed, the required volume of operating fluid is increased, and accordingly energy consumption is increased.

SUMMARY OF THE INVENTION

It is the first object of this invention to provide an index-feed machining system that can eliminate variations in the machining level of the workpiece and reduce energy consumption in index-feed machining, including a drawing process or a bending process.

It is the second object of this invention to provide an index-feed machining system that can reduce machining cost and improve the dimensional accuracy of products involving tapping and other machining processes.

It is the third object of this invention to provide an index-feed machining system having such a construction that the drive force of working load of a particular machining unit can be selectively increased.

BRIEF DESCRIPTION OF THE DRAWINGS

FIG. 3A showing the state before drawing, FIG. 3B the state in the process of drawing, and FIG. 3C the state after drawing, respectively.

DETAILED DESCRIPTION OF THE EMBODIMENTS

Figure 1:
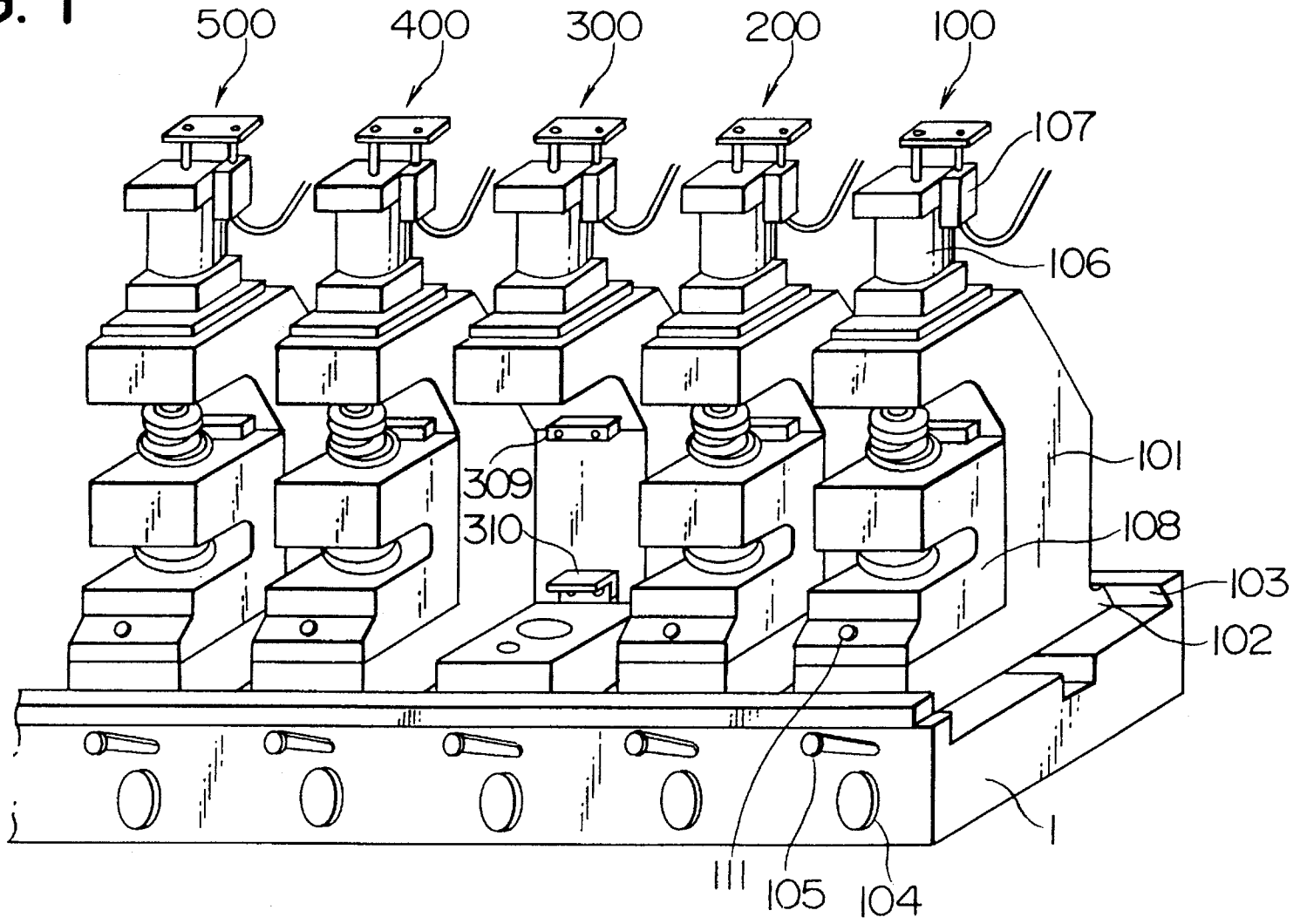
FIG. 1 is a perspective view illustrating the essential part of an index-feed machining system on which this invention is based.
Figure 4:
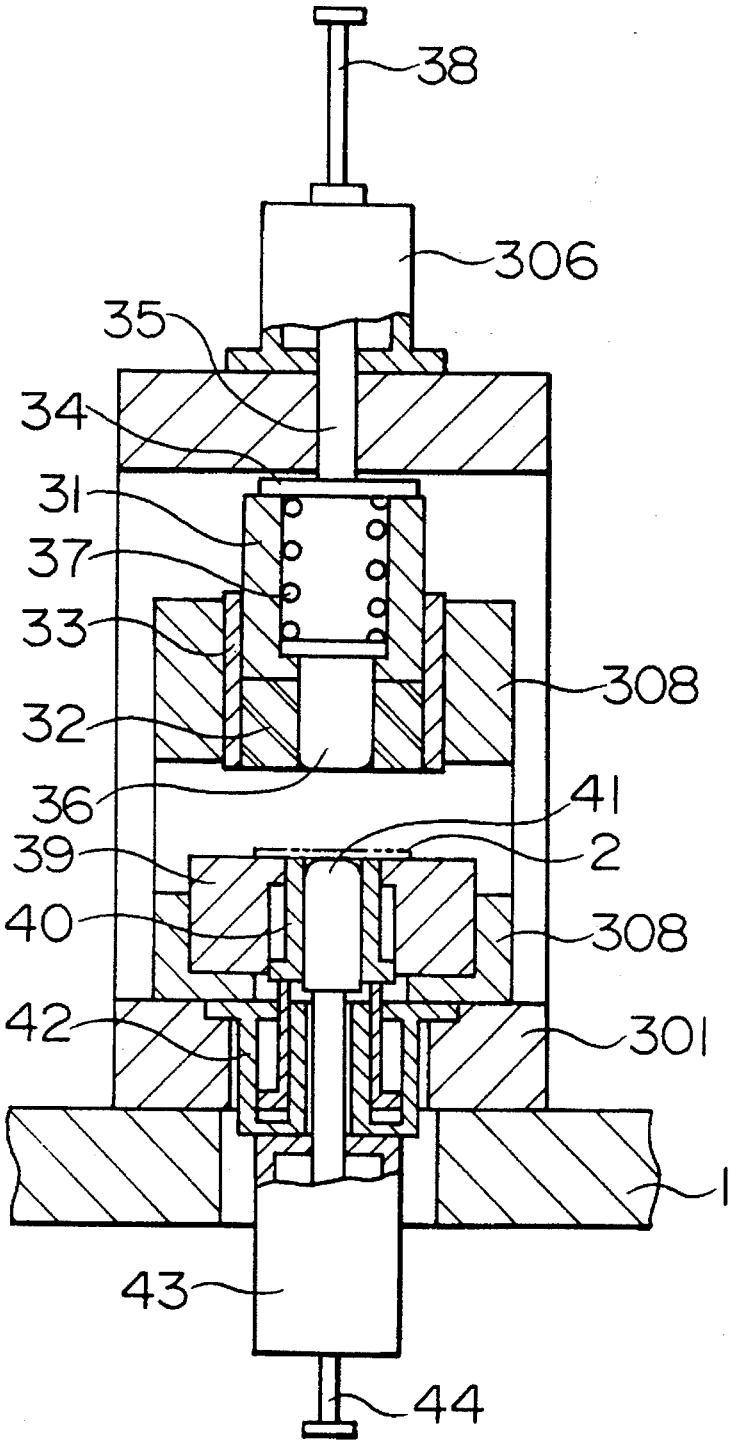
FIGS. 4 and 5 are cross-sectional front view and side view illustrating the essential part of the first embodiment of this invention.
Figure 5:
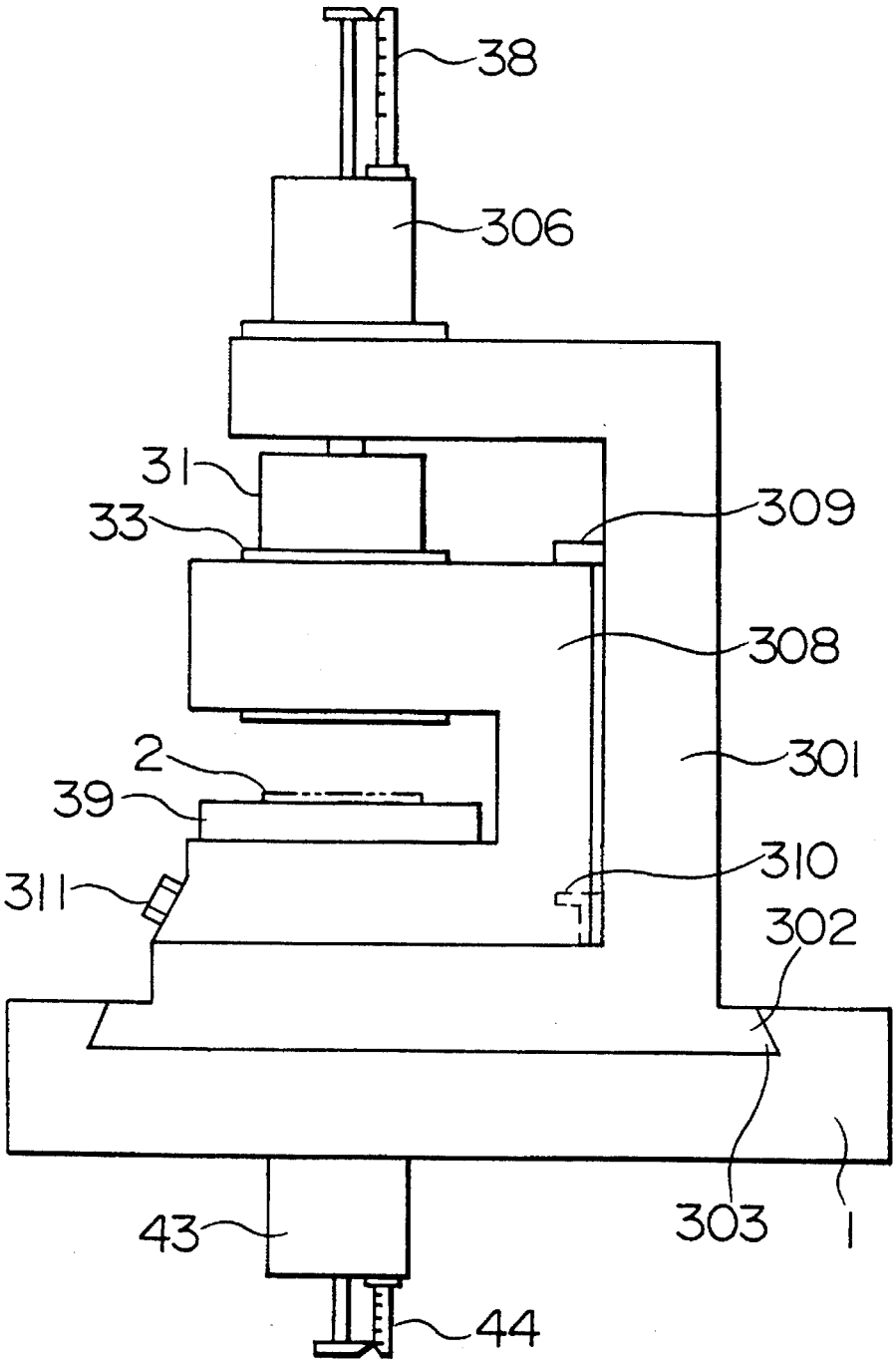

FIGS. 4 and 5 are longitudinal sectional front view and side view showing the essential part of the first embodiment of this invention. In FIGS. 4 and 5, numeral 301 denotes a machining unit body corresponding to that for the first drawing operation in FIG. 1. The machining unit body 301 is mounted on a base 1 via a dovetail 302 engaged with a dovetail groove 303 provided on the base 1. A cassette 308 having a deep-drawing die and punch, which will be described later, is fixedly fitted at a predetermined location of the machining unit body 301 via positioning members 309 and 310, and a clamp screw 311. Numeral 306 denotes a hydraulic cylinder or machine driving means for operating a first tool of a die, which will be described later.

Numeral 31 denotes a die-mounting member to the lower end of which a deep-drawing die 32 is fixedly fitted. The die-mounting member 31 is provided vertically movably via a sleeve 33 fitted to the cassette 308, and connected to a rod 35 engaged with the hydraulic cylinder 306 via a connecting member 34. Numeral 36 denotes a knockout pin vertically movably fitted in the die-mounting member 31 and the die 32, and preloaded downward by a spring 37. Numeral 38 denotes a position measuring device provided on the upper part of the hydraulic cylinder 306.

Numeral 39 denotes a retainer member fixedly fitted to the lower part of the cassette 308 and holding a blank holding pad 40 and a punch 41 in a vertically movable fashion. Next, numerals 42 and 43 denote a blank-holding-pad hydraulic cylinder, and a punch hydraulic cylinder or second tool arriving means, provided at the lower part of the machining unit body 301, and connected directly or via a rod or other linkage member to the blank holding pad 40 and the punch 41, respectively. Numeral 44 denotes a position measuring device provided at the lower part of the punch or second tool hydraulic cylinder 43. The position measuring devices 38 and 44 detect the vertical moving ends of the die 32 and the punch 41, respectively, so that the application and release of hydraulic pressure to the hydraulic cylinder 306 and the punch hydraulic cylinder 43 can be controlled.

Figure 2A:
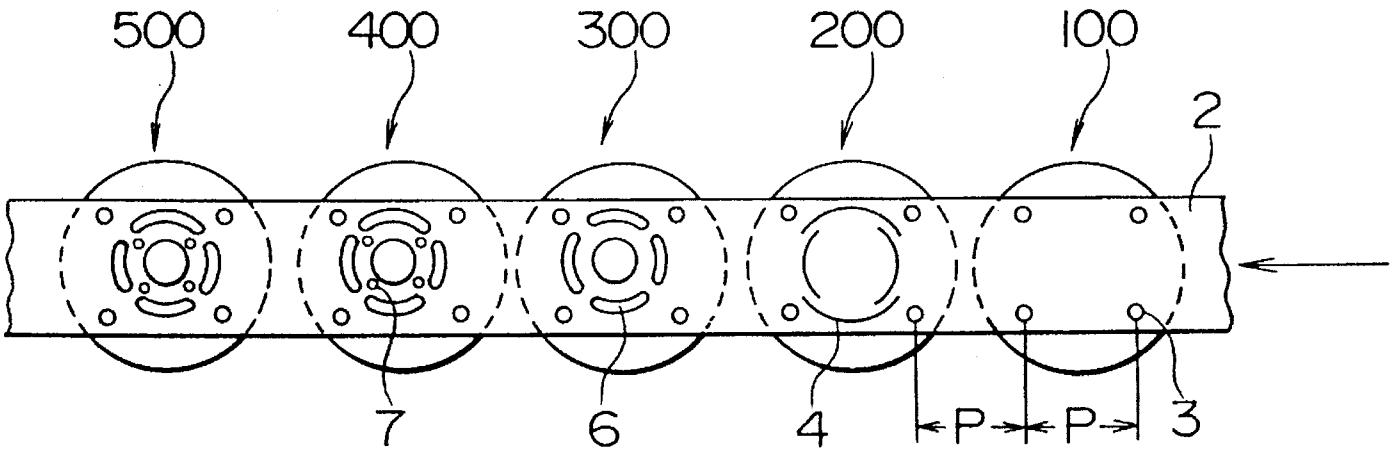
FIGS. 2A and 2B are a plan view and cross-sectional view illustrating the machining state of a workpiece.
Figure 2B:
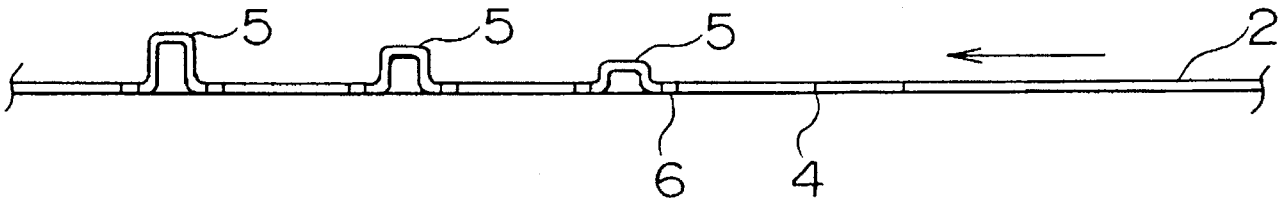

With the above-mentioned construction, the hydraulic cylinder 306 is first operated to lower the die 32 and the knockout pin 36 until the lower ends thereof come in contact with the workpiece 2, and the workpiece 2 is held by the retainer member 39, the blank holding pad 40 and the punch 41. Then, operating fluid is introduced into the blank-holding-pad hydraulic cylinder 42 and the punch hydraulic cylinder 43 to cause the blank holding pad 40 and the punch 41 to move upward. By doing this, the blank holding pad 40 and the die 32 hold the workpiece 2 while the punch 41 enters into the die 32 against the preloaded pressure of the spring 37 to perform the first drawing operation (the forming of the projection 5 [see FIG. 2B.] by the machining unit 300 in FIG. 2A).

Figure 3A:
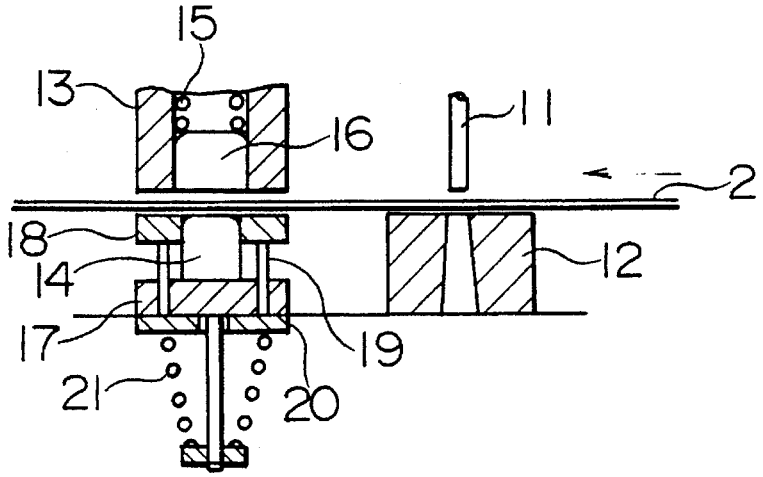
FIGS. 3A through 3C are cross-sectional diagrams of assistance in explaining the state where drawing is performed.
Figure 3B:
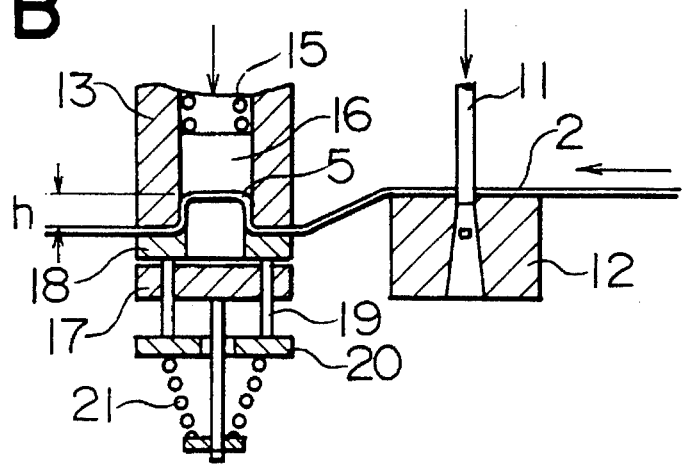
Figure 3C:
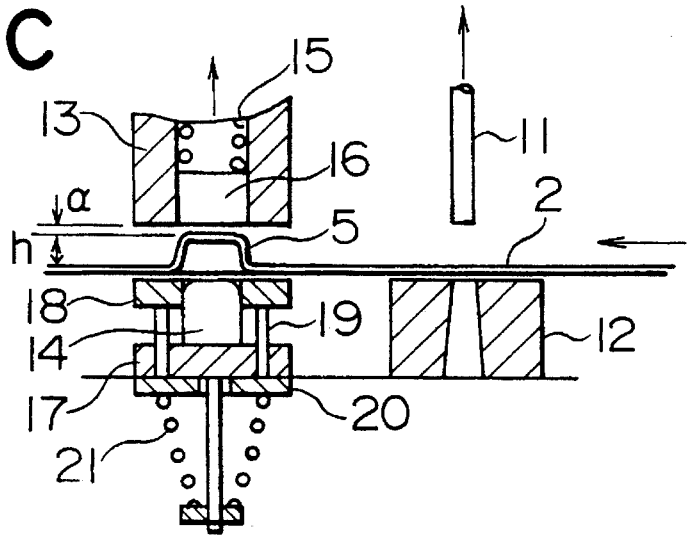
Figure 6:
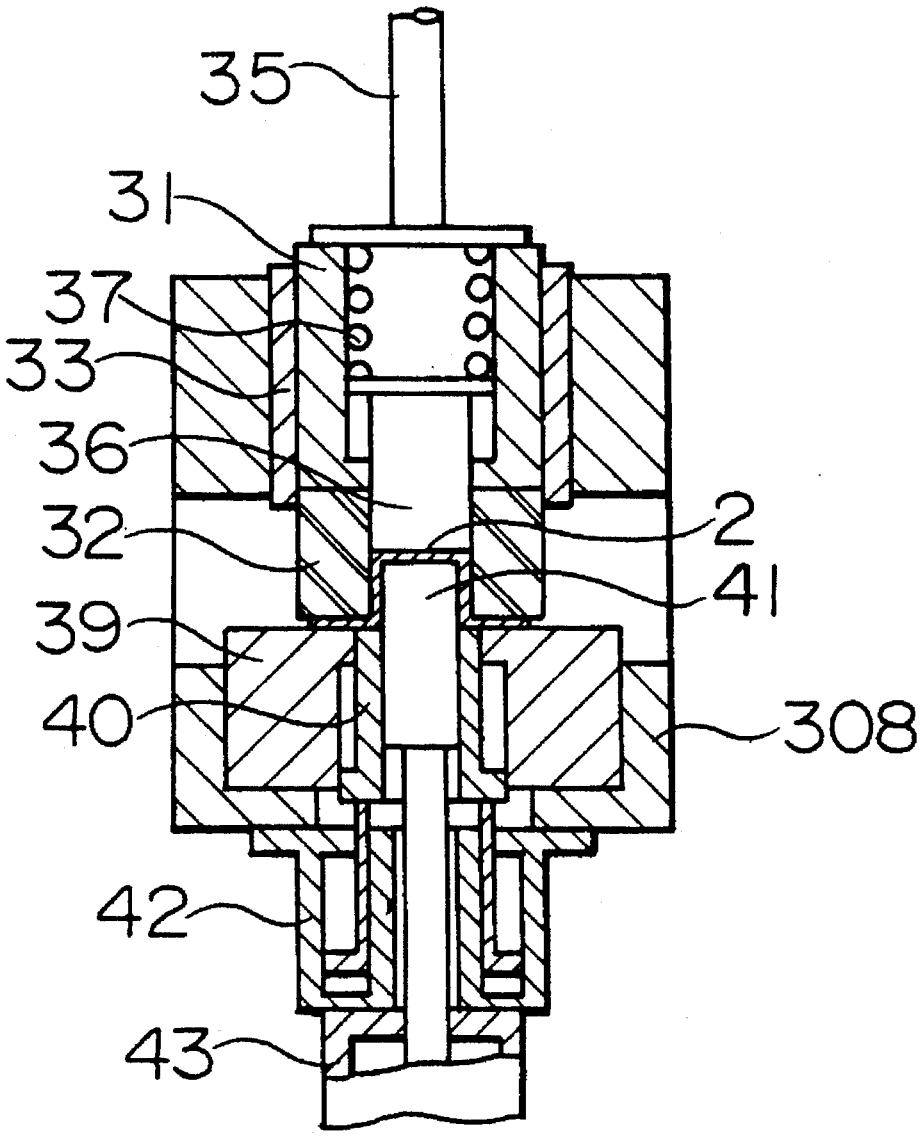
FIG. 6 is a cross-sectional view illustrating the state of the first drawing step in the first embodiment of this invention.

FIG. 6 is a cross-sectional view illustrating the state of the first drawing operation. Like parts are indicated by like numerals in FIGS. 4 and 5. As is evident from FIG. 6, even after the punch 41 has entered into the die 32 in the first drawing operation, the level of the workpiece 2 is substantially the same as the state before machining, and no deformation of the workpiece 2 is produced, as can be seen in FIG. 3B showing the machining state in the prior-art system.

Upon completion of the first drawing operation, as the hydraulic pressure in the blank-holding-pad hydraulic cylinder 42 and the punch hydraulic cylinder 43 is released, the blank holding pad 40 is deenergized and the punch 41 is lowered. Thus, the knockout pin 36 is pushed downward by the spring 37. Simultaneously with the above operation, or after the lapse of a certain time, as the hydraulic cylinder 306 is operated in the opposite direction, the die 32 is raised, and the workpiece 2 is discharged out of the die 32 by the spring 37, returning to the state shown in FIGS. 4 and 5 to complete the first drawing operation.

FIGS. 7A through 7D are cross-sectional views illustrating the state of the second drawing operation. Like parts are indicated by like numerals in FIG. 6. Upon completion of the first drawing operation as shown in FIG. 6, the workpiece 2 is indexed to the machining unit 400 corresponding to the second drawing operation in FIGS. 1 and 2A through 2B for the second drawing operation of the projection 5. In FIGS. 7A through 7D, the reference numerals of the component members are the same as those in FIG. 6 to facilitate understanding.

Figure 7A:
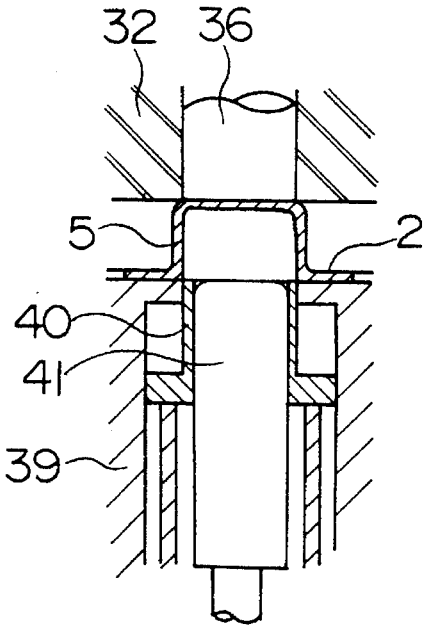
FIGS. 7A through 7D are cross-sectional views illustrating the second drawing step in the first embodiment of this invention.
Figure 7B:
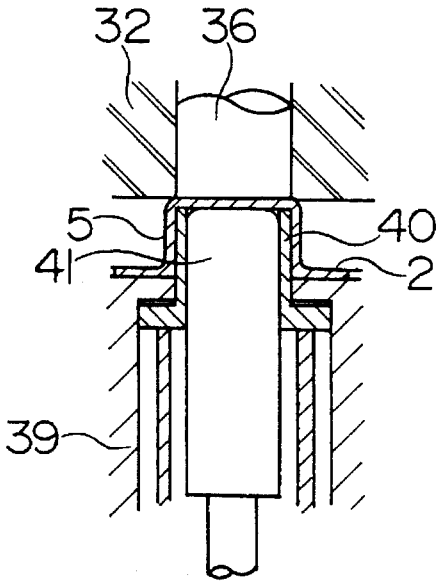
Figure 7C:
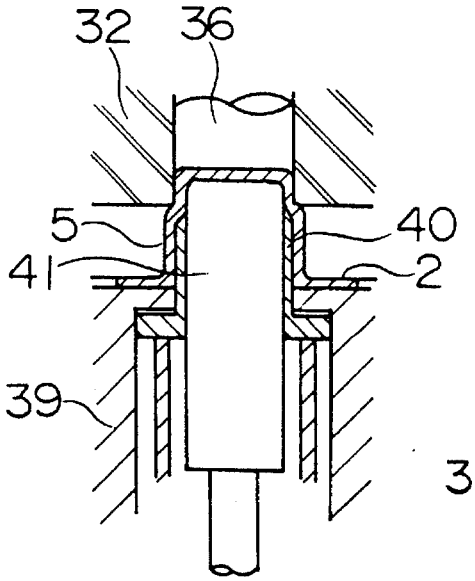

In FIG. 7A, as the die 32 and the knockout pin 36 are lowered, the knockout pin 36 comes in contact with the upper end of the projection 5 which has been formed in the first drawing operation. As shown in FIG. 7B, the blank holding pad 40 and the punch 41 are raised, entering into the projection 5 and reaching the upper end of the projection 5. In this state, the punch 41 is further raised, entering further into the die 32 and performing part of the second drawing operation to increase the height of the projection 5, as shown in FIG. 7C.

Figure 7D:
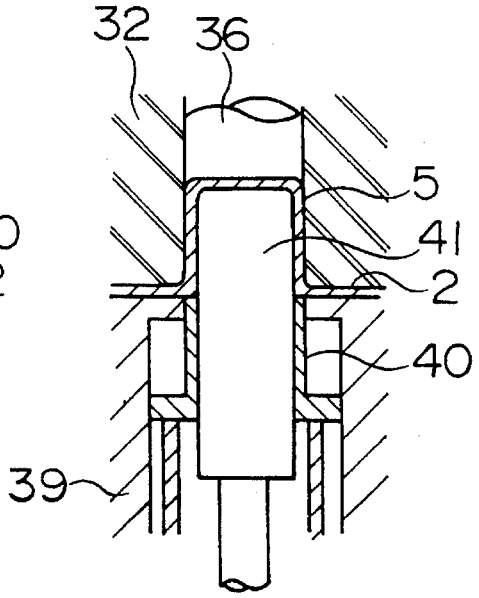

In this case, the blank holding pad 40 forces the outer periphery of the top of the projection 5 onto the die 32 at a predetermined pressure, permitting the workpiece 2 to be slid and plastically deformed while preventing wrinkles from generating. Then, the die 32 is lowered, as shown in FIG. 7D, to continue and complete the second drawing operation while holding the workpiece 2 between the die 32 and the blank holding pad 40. Upon completion of the second drawing operation, the punch 41 is lowered and the die 32 is raised. At this time, the knockout pin 36 is moved down in the die 32 while pushing the top of the projection 5, and returned to the state shown in FIG. 7A. During the second drawing operation, the workpiece 2 is kept at essentially the same level, as in the case of the first drawing operation. In the third drawing operation, the same procedures as above are followed.

Although description has been made about drawing operation, in this embodiment, the same can be applied to bending and compressing operations. Description has also been made about oil-hydraulic cylinders using as the driving means, but other types of fluid-pressure cylinders using air, water, etc. or other types of driving means than hydraulic cylinders. The intervals of the machining units can generally be mP (m being a positive integer), and the intervals can be changed as necessary.

Figure 8:
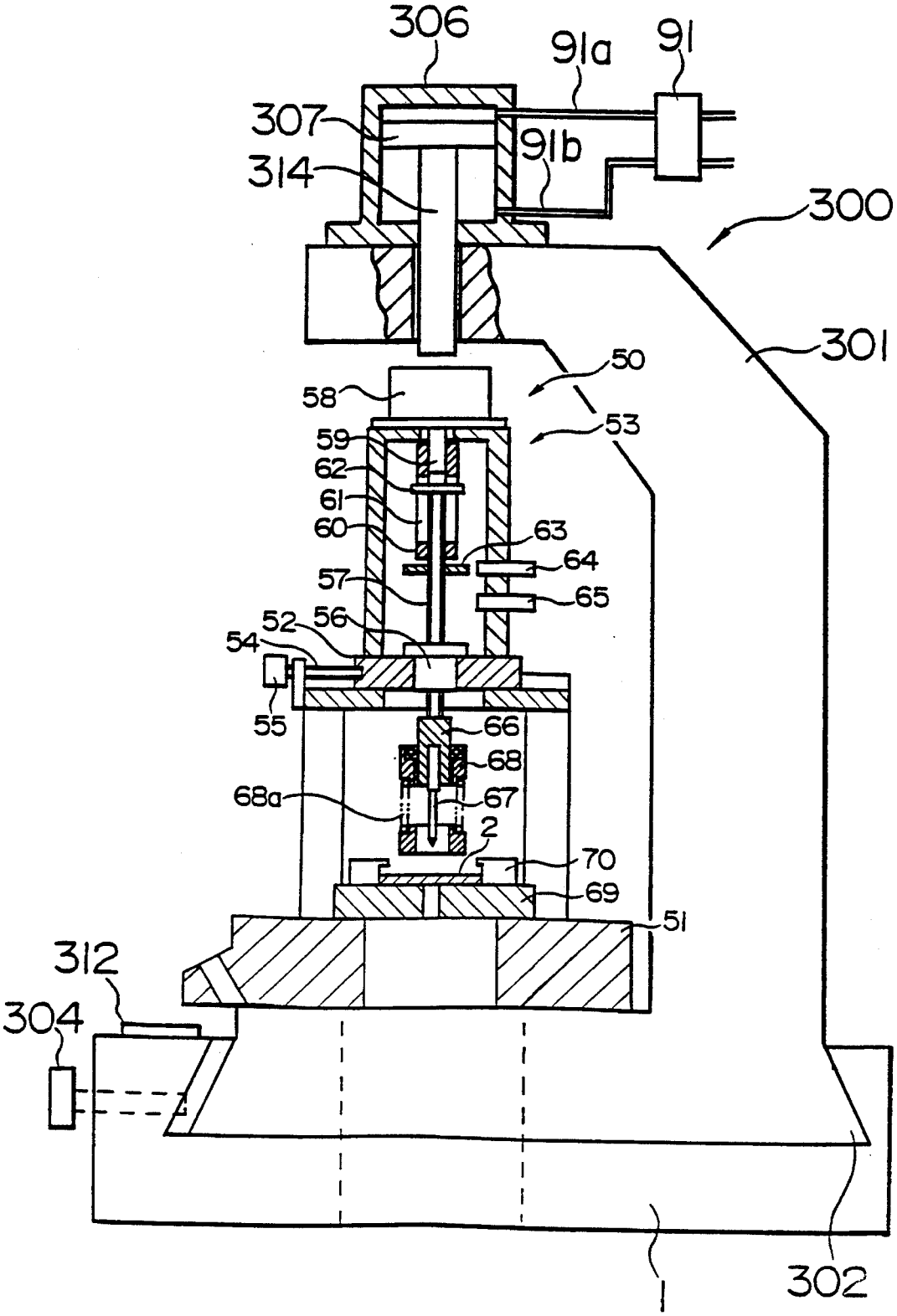
FIG. 8 is a cross-sectional view illustrating the essential part of the second embodiment of this invention.

FIG. 8 is a cross-sectional view illustrating the essential part of the second embodiment of this invention. In FIG. 8, numeral 50 indicates machine tool means such as a threading unit formed in the same manner as the machining units 100–500 or the cassette 108, etc., and provided on the base 1 directly or via the machining unit body 101, etc. The threading unit 50 is located at intervals of mP between any machining units. Numeral 51 denotes a cassette base formed into a box, on the upper end of which a spindle unit 53 is supported via a table 52. The table 52 is formed horizontally movably on the cassette base 51 via an adjusting screw 54. Numeral 55 is an adjusting handle for causing the adjusting screw 54 to rotate.

Next, numeral 56 is a master-screw nut fixedly fitted to the table 52 for receiving the master screw 57. Numeral 58 denotes a spindle motor connected to the master screw 57 via a coupling 60 provided on an output shaft 59. That is, a groove 61 is provided in the axial direction on the coupling 60 to slidably engage with a pin 62 provided on the upper end of the master screw 57. Numeral 63 denotes a position detecting dog; 64 an upper-limit detecting member; 65 a lower-limit detecting member; 66 a tap holder provided on the lower end of the master screw 57 for detachably holding cutting tool means as a tap 67. Numeral 68 denotes a workpiece retainer which is relatively rotatably and provided on the tap holder 66. Numeral 69 denotes a backing plate provided on the lower part of the cassette base 51 for supporting a workpiece guide 70, which is formed in an inverted-L shape, for example, for guiding the workpiece 2 so that the workpiece 2 can be moved in the direction normal to the paper surface.

Now, the operation of the embodiment having the above construction will be described. In FIG. 8, as the spindle motor 58 is rotated, the master screw 57 is also rotated via the coupling 60 and the pin 62, causing the workpiece retainer 68 and the tap 67 held by the tap holder 66 to be lowered. When the workpiece retainer 68 comes in contact with the surface of the workpiece 2, the workpiece retainer 68 stops rotating, forcing the workpiece 2 onto the backing plate 69 by the repulsion force of the spring 68*a*. The tap 67 is further lowered to form a threaded hole (not shown) on the workpiece 2. Upon completion of threading operation by the tap 67, the position-detecting dog 63 actuates the lower-limit detecting member 65 to reverse the spindle motor 58, causing the master screw 57 to be raised. During this period, the workpiece retainer 68 keeps pushing the workpiece 2, and is raised, together with the tap holder 66, only after the tap 67 is extracted from the workpiece 2. As the position-detecting dog 63 actuates the upper-limit detecting member to stop the spindle motor 58, completing the current threading operation. Then, the workpiece 2 is index-fed by a predetermined distance for the next threading operation.

Although description has been made about forming a female thread using a tap in this embodiment, the same can be applied to forming a male thread on a round projection on the workpiece. Furthermore, by replacing the master screw and the master-screw nut with an appropriate feeding means or pushing means, drilling, countersinking, chamfering, spot facing, crimping, marking and other machining operation can be carried out.

Figure 9:
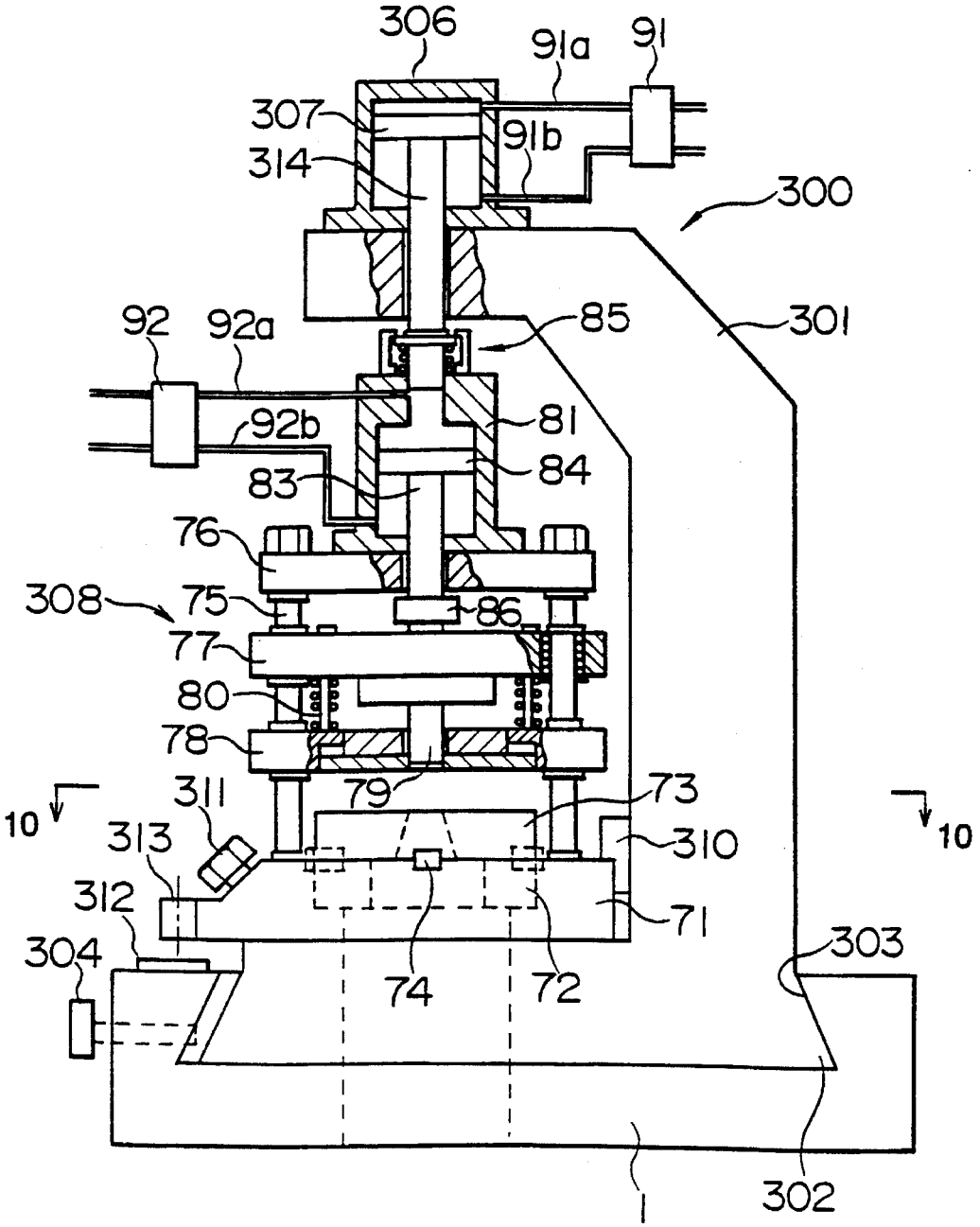
FIG. 9 is a cross-sectional side view illustrating the essential part of the third embodiment of this invention.
Figure 10:
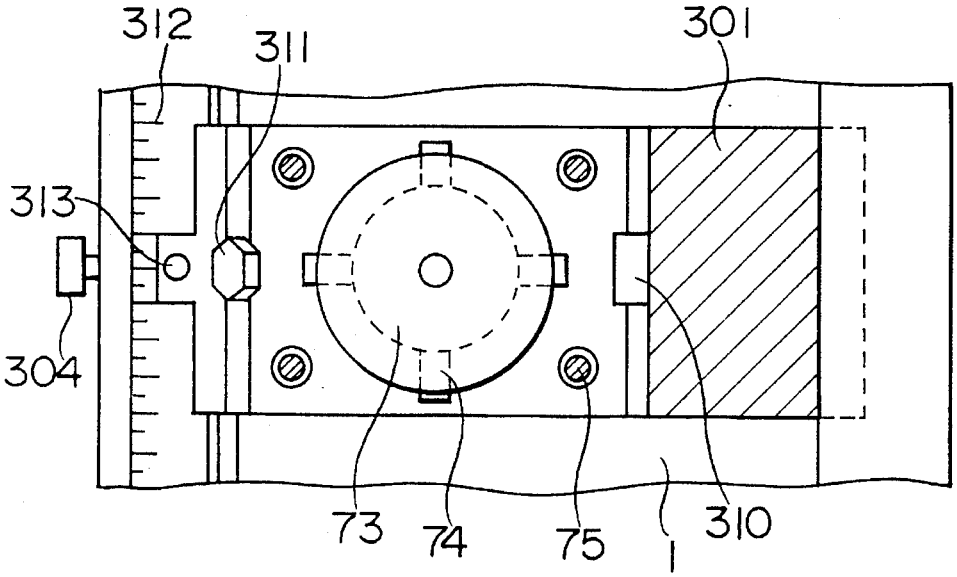
FIG. 10 is a cross-sectional view taken along the line 10—10 in FIG. 9.

FIG. 9 is a cross-sectional side view illustrating the essential part of the third embodiment of this invention. FIG. 10 is a cross-sectional view taken along the line A—A in FIG. 9. In FIGS. 9 and 10, the machining unit body 301 of a machining unit 300 is mounted on a base 1 by engaging a dovetail 302 with a dovetail groove 303 provided on the base 1, and fixedly fitted via a clamp device 304. Numeral 308 is a cassette detachably provided on the machining unit body 301, as will be described later. Numeral 306 denotes a hydraulic cylinder constituting an auxiliary driving means provided on the upper end of the machining unit body 301. The hydraulic cylinder 306 is normally provided on the machining unit body 301 as the driving means, but it is used in this invention as an auxiliary driving means for boosting the hydraulic pressure in a manner as will be described later.

Next, the construction of the cassette 308 will be described. Numeral 71 denotes a base plate formed into a flat plate shape, on which a die holder 72 is embedded and a die 73 is detachably provided. The die holder 72 and the die 73 are formed into a matching projection/recess set, and positioned via a reference part 74 provided radially. Numeral 75 denotes guide posts provided at four corners of the base plate 71. On the upper ends of the guide posts 75 there is provided a fixing plate 76 formed into a plate shape. Numeral 77 denotes a movable holder; 78 a stripper supporting plate slidably fitted to the guide posts 75. A punch 79 forming a pair with the die 73 is provided on the movable holder 77 in such a manner as to pass through the stripper supporting plate 78. The movable holder 77 and the stripper supporting plate 78 are connected to each other via a supporting rod 80 in such a manner as to be relatively movable.

Numeral 81 denotes an hydraulic cylinder constituting the main driving means, fixedly fitted to the upper part of the fixing plate 76, and vertically slidably incorporating a piston 84 having a rod 83 fixedly fitted thereto. The rod 83 is connected to the movable holder 77 via a stroke adjusting member 86. Numeral 310 denotes a positioning member; 311 a clamp member; 312 a scale provided on the base 1; 313 a position measuring device, respectively. The hydraulic cylinders 306 and 81 have such a construction that the pistons 307 and 84 are individually driven by supplying and discharging the operating fluid from the hydraulic circuit through the selector valves 91 and 92 and pipings 91*a*, 91*b*, 92*a* and 92*b*.

Figure 11:
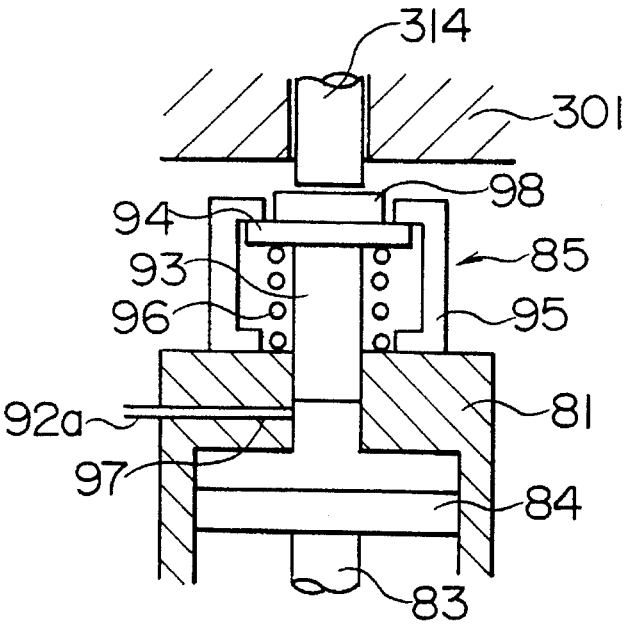
FIG. 11 is an enlarged longitudinal sectional view illustrating the neighborhood of a relay member 85 in FIG. 9.

Numeral 85 denotes a relay member or means having such a construction as will be described later, referring to FIG. 11, which is an enlarged longitudinal sectional view, and provided between a rod 314 formed integrally with the piston 307 fitted to the hydraulic cylinder 306, and the hydraulic cylinder 81. In FIG. 11, numeral 93 denotes a relay rod having an integrally formed flange 94 on the upper part thereof, and provided in such manner as to enter into the hydraulic cylinder 81. Numeral 95 denotes a retaining member formed into a U shape, for example, provided on the upper part of the hydraulic cylinder 81, and retaining the relay rod 93 that is preloaded upward by a coil spring 96. The relay rod 93 is provided in such a manner that the lower end thereof is held at a location slightly higher than the opening 97 (leading to the piping 92*a*) for the operating fluid of the hydraulic cylinder 81. On the upper end of the flange 94 there is provided a contact part 98 that can make contact with and detach from the rod 314. The hydraulic cylinder 306 constituting the auxiliary driving means has the aforementioned construction.

The operation of the embodiment having the aforementioned construction will be described, referring to FIGS. 9 through 11. After the operating position of the punch 79 is adjusted by the stroke adjusting member 86, the operating fluid from the hydraulic circuit is fed to the upper part of the hydraulic cylinder 81 via the selector valve 92 and the piping 92*a*. Then, the piston 84 is driven, causing the rod 83 to be lowered and the stripper supporting plate 78 to make contact with a workpiece (not shown), and the punch 79 and the die 73 can perform desired punching, bending, drawing, compression and other forming operations on the workpiece.

In the final stage of drawing operation, for example, if even a greater driving force is required, the operating fluid is supplied to the upper parts of the hydraulic cylinder 306 constituting the auxiliary driving means from the piping 91a via a control device (not shown) and the selector valve 91 as a detection signal is generated by a position detecting device (not shown) which detects that the piston 84 and the rod 83 of the hydraulic cylinder 81 constituting the main driving means reaches a predetermined position. As a result, the rod 314 connected to the piston 307 is lowered, and comes in contact with the contact part 98 shown in FIG. 11, causing the relay rod 93 to be lowered. Then, the relay rod 93 enters into the hydraulic cylinder 81 against the repulsion force of the coil spring 96.

As the relay rod 93 is lowered, on the other hand, the opening 97 of the piping 92*a* is closed, sealing the operating fluid in the upper part of the hydraulic cylinder 81. In other words, a greater pushing force can be exerted to the rod 83 because the pressure of the operating fluid in the hydraulic cylinder 81 is boosted as the relay rod 93 enters into the hydraulic cylinder 81. That is, assuming that the cross-sectional areas of the piston 84 and the relay rod 93 are $A_1$ and $A_2$, the pressure of the operating fluid in the hydraulic cylinder 81 can be boosted by $A_1/A_2$ times. If the pressure of the operating fluid in the pipings 91*a* and 92*a* is 140 kg/cm$^2$, and $A_1/A_2=3$, then the pressure of the operating fluid in the hydraulic cylinder 81 can be increased to 420 kg/cm$^2$.

When the punch 79 reaches the bottom position, the supply of operating fluid to the upper part of the hydraulic cylinders 306 and 81 is discontinued, and operating fluid is fed to the lower part of the hydraulic cylinders 306 and 81 by the action of the selector valves 91 and 92. This causes the punch 79 to be raised, then the stripper supporting plate 78 to be raised until the punch 79 reaches the top position to a halt. After all the machining units reach their top positions, the workpiece is index-fed to the left in FIGS. 2A and 2B to repeat the next machining. In FIG. 11, as the rod 314 is raised, the relay rod 93 is also raised by the preloaded upward force of the coil spring 96 and the pressure of the operating fluid in the hydraulic cylinder 81, and stopped in the state where the flange 94 comes in contact with the retainer member 95, keeping the lower end of the rod 314 separated from the contact part 98.

In this way, the lower end of the rod 314 and the contact part 98 are kept separated in the inactive state, the cassette 308 shown in FIG. 9 can be replaced with ease. In addition, even when the axial lines of the rod 314 and the relay rod 93 are slightly misaligned, the operation of the rod 314 and the relay rod 93 is hardly affected.

Figure 12:
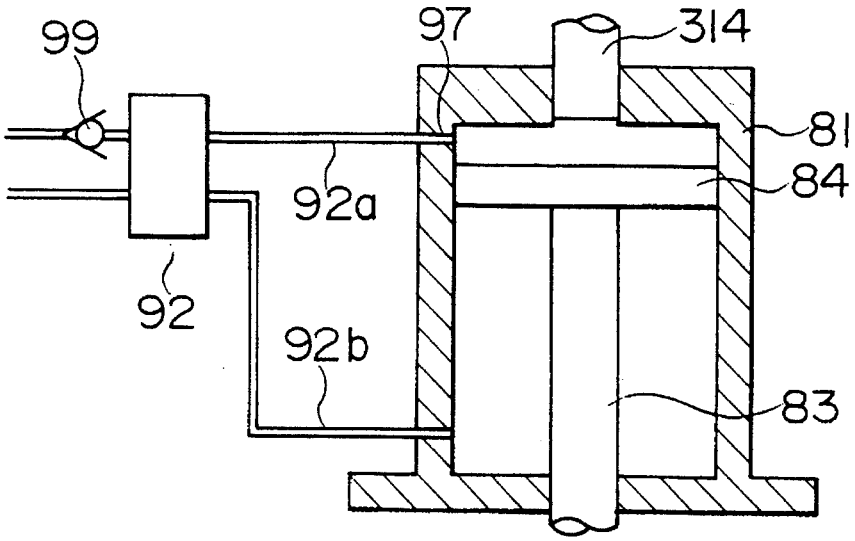
FIG. 12 is a longitudinal sectional view illustrating the essential part of a variation of the hydraulic cylinder 81 in FIG. 9.

FIG. 12 is a longitudinal sectional view illustrating the essential part of a variation of the hydraulic cylinder 81 as shown in FIGS. 9 and 11. Like parts are indicated by like numerals in FIGS. 9 and 11. In FIG. 12, the opening 97 of the piping 92*a* is provided in the vicinity of the top position of the piston 84 in the hydraulic cylinder 81, and a check valve 99 is installed in the piping 92*a*. With the aforementioned construction, the operating fluid fed to the upper part of the piston 84 of the hydraulic cylinder 81 is shut off as the relay rod 93 is lowered. Thus, the pressure of the operating fluid can be increased as in the case shown in FIG. 11. Thus, a large pushing force can be exerted to the rod 83.

Although description has been made about the case where oil-hydraulic cylinders are used as driving means for machining units in this embodiment, other fluids, such as air, water, etc., may be used as a pressure medium. Description has also been made about the case where two stages of hydraulic cylinders are used, but three or more stages of hydraulic cylinders may be adopted, depending on driving force requirements. Furthermore, the construction of cassettes need not be limited to that having a fixing plate provided on the guide posts on a base plate, but a tunnel or square column type, or any other types may be employed so long as the construction incorporates machining means and can pass a hoop-shaped workpiece.

This invention having the aforementioned construction and operation can accomplish the following effects.

(1) The stroke of driving means and energy consumption can be reduced in index-feed machining operations, including drawing or bending.

(2) Since the workpiece is machined on essentially the same level, and no unwanted deformation or distortion is generated in the workpiece, machining accuracy can be improved.

(3) Because the stroke of drawing and other machining means is small, metal dies and other tools can be manufactured easily, and dimensional accuracy can be improved.

(4) Since machining can be carried out simultaneously with the index-feeding of the workpiece, machining efficiency is high, and cost reduction can be accomplished.

(5) No machining jigs are required, compared with machining on individual products, and additional time and labor for installing and removing machining jigs can be reduced, and machining accuracy can be improved.

(6) As the construction of this invention is such that an auxiliary driving means is operated only when a larger driving force is required for machining, high-pressure operating fluid need not be prepared separately, and energy consumption can be reduced.

(7) Since the operating position of the driving means is controlled for each machining unit, the consumption of operating fluid can be reduced and the time required for machining can be reduced.

(8) Since the main driving means and the auxiliary driving means are separately provided in cassettes and machining unit bodies, respectively, boosted pressure can be withstood by increasing the strength of the cassettes, and machining unit bodies need not be reinforced. This permits machining unit bodies to be standardized.

(9) Even when the driving force or working load of a particular machining unit has to be increased, the driving means of the machining unit body need not be changed substantially. This permits the entire system to be made compact.

(10) Since a relatively wide space can be secured in a cassette, a plurality of machining means can be incorporated in the same cassette due partly to the factor mentioned in (1) above. This makes it possible to index-feed large-sized products.

(11) Even when a machining means in a cassette has to be replaced, the positioning of component members can be accomplished quickly and with high precision, the operating rate of the entire system can be improved.

What is claimed is:

1. An index-feed machining system comprising:

a base;

a plurality of machining units positioned at predetermined intervals on said base in a workpiece feeding direction;

a plurality of cassettes, each one of said plurality of cassettes being positionable in one of said plurality of machining units, said plurality of machining units and said plurality of cassettes together sequentially performing a plurality of machining processes on a workpiece as the workpiece is passed in said workpiece feeding direction through said cassettes positioned in said machining units each of said plurality of cassettes are detachably connected inside one of said plurality of machining units;

a first one of said plurality of cassettes has sheet metal machine means for sheet metal working;

a second one of said cassettes includes machine tool means for performing a machining operation on the workpiece, said machine tool means being movable toward and away from the workpiece, said second cassette being positionable in any one of said plurality of machining units at any one of said predetermined intervals on said base;

cassette driving means positioned in said second cassette and for driving said second cassette;

machine driving means connected to each one of said plurality of machining units and for selectably operating said cassettes positioned in said machining unit positioning member means on each of said plurality of machining units and for positioning each of said plurality of cassettes at a predetermined location on said each of said plurality of machining units.

2. A system in accordance with claim 1, wherein:

said sheet metal means performs stamping processes on the workpiece and said machine tool means performs rotary cutting processes on the workpiece.

3. A system in accordance with claim 1, wherein:

said machining operation of said machine tool means is one of drilling, countersinking, chamfering, spot facing, crimping and marking.

4. A system in accordance with claim 1, wherein:

said machine tool means includes a master-screw nut fixed to said third cassette, said machine tool means also including a spindle motor with a master screw threadingly engaged with said master-screw nut and a workpiece retainer means connected to said master-screw for holding the workpiece when said spindle motor rotates the master-screw through said master-screw nut and towards the workpiece, said machine tool means also including cutting tool means positioned on end of said master-screw opposite said spindle motor and for cutting the workpiece with rotational and axial movements of said master-screw.

5. An index-feed machining system as set forth in claim 1, wherein:

said machine tool means is a threading means for forming threads on the workpiece.

6. An index-feed machining system as set forth in claim 1, wherein:

a third one of said plurality of cassettes has a first tool, a second tool, and a second tool driving means for operating said second tool, said first tool being operated by said machine driving means of an associated machining unit.

7. An index-feed machining system as set forth in claim 6 wherein;

said machine driving means and said second tool driving means are formed by fluid-pressure cylinders.

8. A system in accordance with claim 1, wherein:

said machine driving means of a machining unit which accommodates said second cassette is selected to not operate said second cassette.

9. A system in accordance with claim 1, wherein:

said cassette driving means is self-contained within said second cassette;

each machine driving means is positioned on a respective machining unit.

* * * * *